United States Patent [19]

Staun et al.

[11] Patent Number: 4,715,402

[45] Date of Patent: Dec. 29, 1987

[54] SHIPMENT HOSE STORAGE FOR APPLIANCES

[75] Inventors: Paul R. Staun, St. Joseph Township, Berrien County; James R. Mulder, Berrien Township, Berrien County, both of Mich.

[73] Assignee: Whirlpool Corporation, Benton Harbor, Mich.

[21] Appl. No.: 947,649

[22] Filed: Dec. 30, 1986

[51] Int. Cl.[4] ..... A62C 35/00

[52] U.S. Cl. ..... 137/355.17; 248/68.1; 248/75; 248/74.2; 248/317

[58] Field of Search ..... 248/75, 68.1, 74.2, 248/312, 317; 137/355.16, 355.17, 899, 374

[56] References Cited

U.S. PATENT DOCUMENTS

| | | | |
|---|---|---|---|
| 2,954,194 | 9/1960 | Alfano | 248/75 |
| 3,270,892 | 9/1966 | Dennis et al. | 248/317 |
| 3,456,680 | 7/1969 | Martiniale | 137/355.17 |
| 3,521,332 | 7/1970 | Kramer | 248/74.2 |
| 3,880,188 | 4/1975 | Oakley, Jr. et al. | 137/355.17 |
| 3,897,923 | 8/1975 | Paepke et al. | 248/75 |
| 4,027,842 | 7/1977 | Mittleman | 248/75 |
| 4,159,717 | 7/1979 | Cossey | 137/316 |
| 4,168,423 | 9/1979 | Gilreath | 248/74.2 |
| 4,358,082 | 11/1982 | Reeves | 248/75 |

*Primary Examiner*—A. Michael Chambers

*Attorney, Agent, or Firm*—Hill, Van Santen, Steadman & Simpson

[57] ABSTRACT

A hose retainer is provided for removably securing hoses within a cabinet of the appliance. The retainer includes a hook for securing the apparatus to a structure inside the appliance, a slit for receiving an end of a hose, and in one embodiment at least one aperture for receiving an end of a second hose. In a second embodiment the apparatus includes an arm and projection for securing an end of the second hose. The appliance includes access ports for affording access to a portion of the hoses.

15 Claims, 7 Drawing Figures

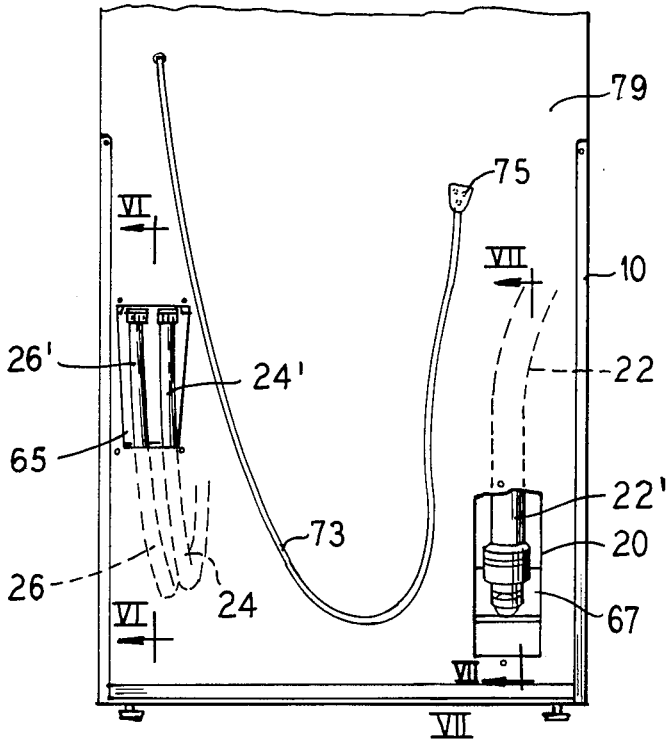
FIG. 5
FIG. 6
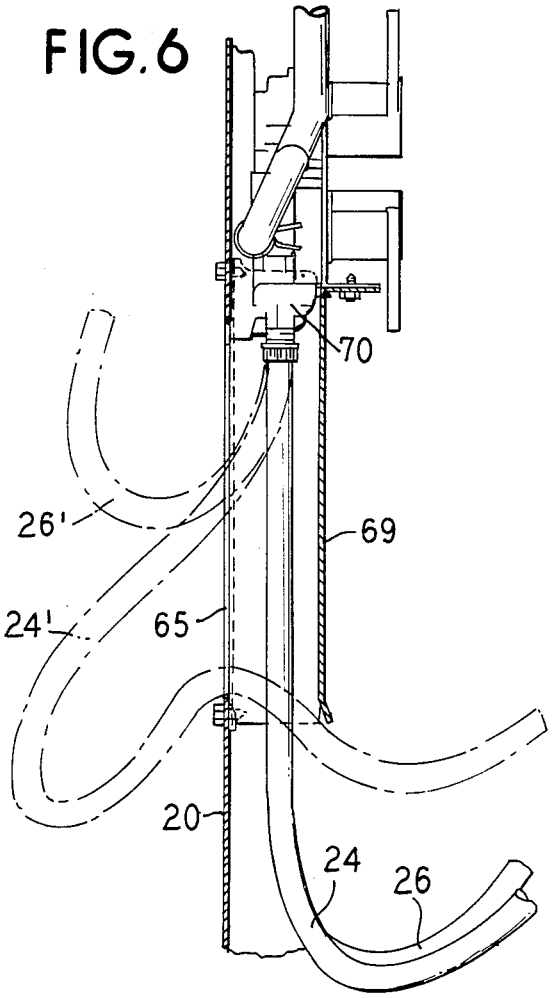
FIG. 7
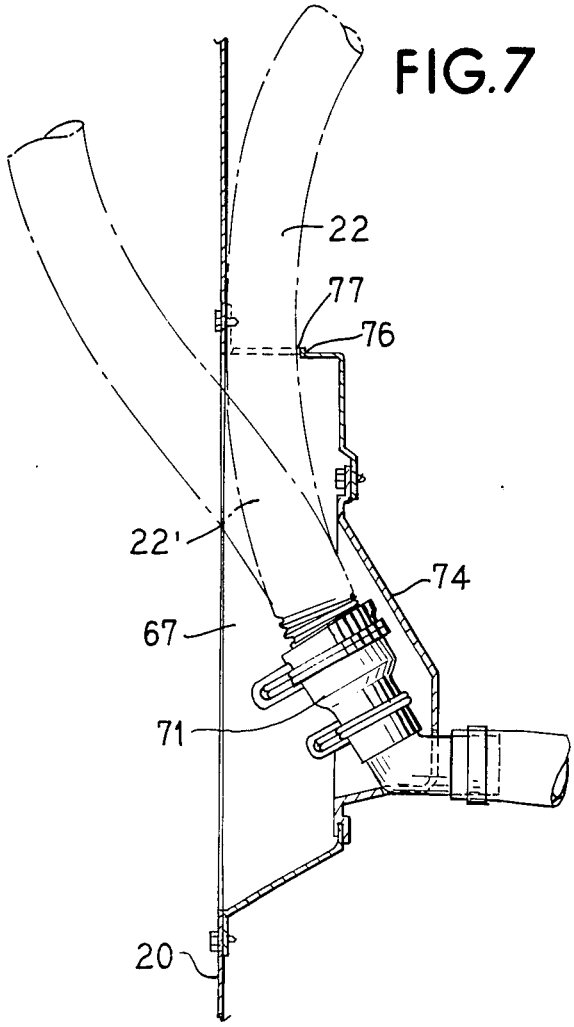

SHIPMENT HOSE STORAGE FOR APPLIANCES

BACKGROUND OF THE INVENTION

1. Field of the Invention

The present invention relates to hose storage means particularly adapted for use in an appliance such as an automatic washing machine.

2. Description of the Prior Art

Home appliances such as, for example, an automatic washing machine, are provided with hoses that connect the appliance to a water source, such as a hot and cold water line, and a discharge line for discharging the water used by the appliance. For example, an automatic washing machine typically includes two inlet hoses, one for cold water and one for hot water, and a drain hose for discharging the water used to wash and rinse. Once the appliance is located in the home of the consumer, it is necessary for a serviceperson or the consumer to access the hoses so that the appliance can be set up for operation. However, these hoses typically are stored somewhere within the appliance so that they are not damaged during shipment of the appliance. Accordingly, the method of storing the hoses must be tempered with the need of access to the hoses so that the hoses can be attached to the inlets for the hot and cold water and to insure that the drain hose is situated in a suitable drain.

Usually, the hoses are loosely located within the appliance. For example, it is known to roll up and locate the hoses in the tub of the automatic washer for shipment of the appliance to the consumer. U.S. Pat. No. 3,880,188 discloses a hose retractor for a portable appliance. As disclosed, the hoses are located normally stored within the cabinet when the appliance is not in use and pulled out for connection to a sink faucet. A hose retracting device facilitates retraction and storage of the hoses in the cabinet.

It would be advantageous to have an appliance that includes means for securing the hoses within the appliance yet provides a means for allowing easy access to the hoses to make the appliance operational.

SUMMARY OF THE INVENTION

The present invention provides an appliance that includes an apparatus that allows the drain hose and the inlet water hoses to be factory installed within the cabinet of the appliance. The appliance further includes access ports for selectively accessing the hoses.

An apparatus provided for removably securing the hoses within the cabinet of the appliance includes a hose retainer member having a hook portion for securing the apparatus to an internal portion of the appliance, as well as a slit for removably receiving a portion of a hose, for example the drain hose, and means for securing at least a second hose, for example, the inlet hose.

The means for securing the second hose may include at least one aperture that preferably includes projections that define a collar.

In another embodiment, the means for securing a second hose includes at least one arm having at the end thereof a slitted deformable projection sized and shaped to be received within an opening in the hose.

The appliance includes a cabinet having access ports for allowing access to corresponding portions of the drain hose and the inlet hoses. The cabinet also includes means for securing an electrical plug to the cabinet.

BRIEF DESCRIPTION OF THE DRAWINGS

FIG. 5 illustrates a back elevational view of a portion of the appliance of FIG. 1.

FIG. 6 illustrates a cross-sectional view of the appliance taken along lines VI—VI of FIG. 5.

FIG. 7 illustrates a cross-sectional view of the appliance taken along lines VII—VII of FIG. 5.

DETAILED DESCRIPTION OF THE PREFERRED EMBODIMENTS

Figure 1:
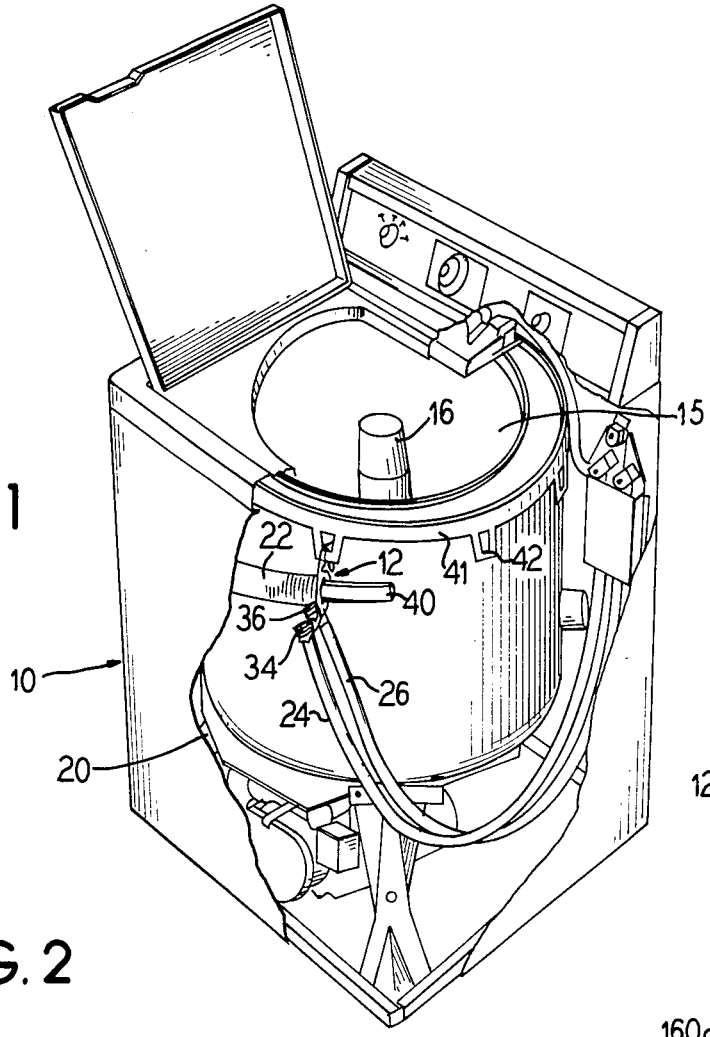
FIG. 1 illustrates a perspective view of the appliance of the present invention with parts broken away including the apparatus for securing the hoses within the appliance.

While the present invention provides a means for storing and accessing hoses within any appliance affording such utilitarian connection, the invention is particularly useful for providing an apparatus for effecting factory installation of hoses in a stored position in an automatic washing machine which are selectively retrievable at the place of utilization. Referring to FIG. 1, an exemplary automatic washing machine is shown at 10 utilizing a hose retainer 12 for removably securing hoses of the present invention.

The automatic washing machine 10 includes a tub 14 that has a clothes container or spin basket 15 in which an agitator 16 is centrally disposed. Circumscribing the top of the tub 14 is a retaining ring 41 that includes downwardly projecting flanges 42. the flange 42 provides a means to which the apparatus 12 for removably securing hoses may be attached. The tub 14, spin basket 15, and agitator 16 along with the drive mechanism are enclosed in a cabinet 20.

Figure 2:
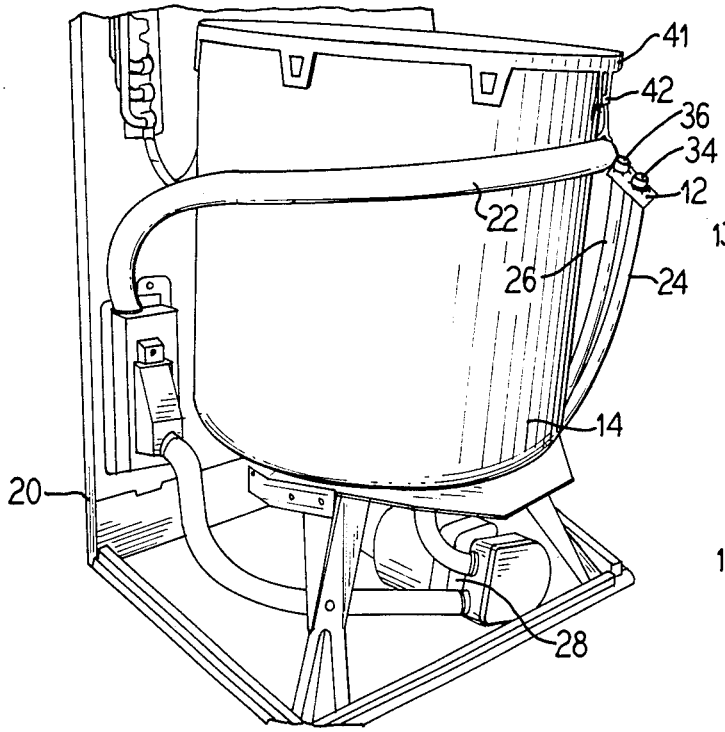
FIG. 2 illustrates a side elevational view of the appliance of FIG. 1 with parts broken away.

As illustrated in FIGS. 1 and 2, the automatic washing machine 10 includes a drain hose 22 and inlet hoses 24 and 26. The inlet hoses 24 and 26 are designed to be secured by the user to the usual domestic supply, i.e. an inlet water source such as a water faucet. The two inlet water hoses 24 and 26 are designed so that one hose can be connected to a cold water source and the other hose can be connected to a hot water source. The drain hose 22 is connected to a pump 28 that functions to pump the water contained within the tub 14 out of the tub and through the drain hose 22 for discharge to a drain, for example, within a basin, laundry tub, pipe drain or other means for allowing the disposal of the liquid drained from the tub 14.

In order to store hoses 22, 24, and 26 against possible damage to the hose and to the appliance 10 due to the hose being snagged or caught as the washing machine 10 is transported, it is desirable when the washing machines 10 are being constructed to store the hoses 22, 24, and 26 for relative safekeeping.

Figure 3:
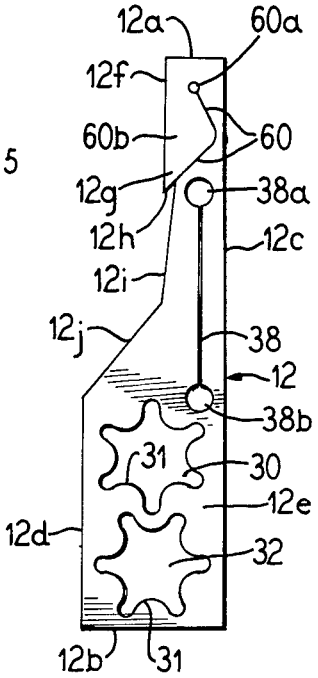
FIG. 3 illustrates one embodiment of a hose retainer for securing the hoses within the appliance.
Figure 4:
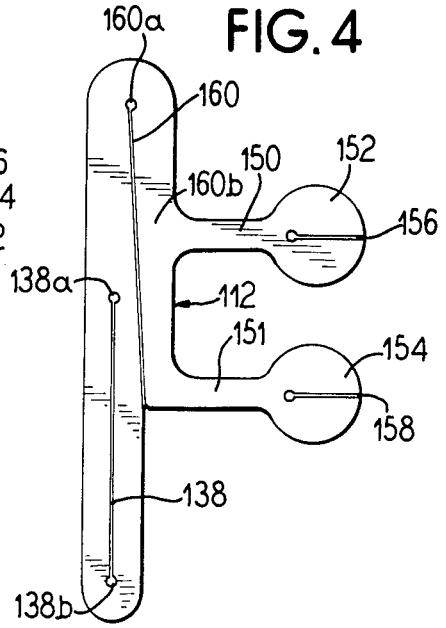
FIG. 4 illustrates another embodiment of a hose retainer for securing the hoses within the appliance.

Referring to FIGS. 3 and 4 two embodiments of a retainer apparatus or a hose retainer 12 for securing the hoses 22, 24, and 26 within the cabinet 20 of the washing machine 10 are illustrated.

Referring specifically to FIG. 3, the base retainer 12 includes a part having two aperturs 30 and 32 that are designed to receive an end 34 and 36 of the hoses 24 and 26 respectively. The base retainer is an elongated sheet-form plastic member having end edges 12A and 12B and joined by a straight longitudinal edge 12C. The end adjacent the edge 12B is enlarged, i.e., it has a longitudinal edge 12D parallel to the edge 12C, thereby to form an enlarged area 12E sufficiently large to accomodate the formation of two hose apertures 30 and 32.

At the end 12*a* of the hose retainer 12, the sheet-form member is much narrower and has a longitudinal edge 12F which proceeds parallel to the edge 12C until it reaches an offset or lug 12G, at which point the offset or lug 12G is formed at reentrant angle 12H. The sheet-form body of the hose retainer 12 is slit at the angle of the hose retainer 12H as at 60 and the slit 60 is itself angled inwardly to terminate at a perforation 60A provided to prevent inadvertent tearing. There is thus formed a hook 60B by means of which the hose retainer 12 may be suspended from a flange 42 that extends downwardly from a ring 41 around the tub 14.

Preferably the apertures 30 and 32 include radial projections 31 that define a collar. Accordingly, in the embodiment illustrated, the apertures 30 and 32 have a star shaped construction wherein an end of the hoses 24 and 26 is insertably received within the apertures 30 and 32 and provides a collar for retaining the inserted ends 34 and 36 of the hoses. The hose retainer 12 also includes a longitudinal slit 38 terminating in openings 38A and 38B that is designed to receive an end portion 40 of the drain hose 22 in an interference fit relationship. The construction of the slit 38 allows the end 40 of the drain hose 22 to be removably retained therein. The longitudinal edge portions 12F and 12D are completed by an angled edge portion 121 and 12J as shown in FIG. 3.

Referring now to FIG. 4, a second embodiment of the retainer apparatus or hose retainer 112 for securing the hoses 22, 24, and 26 is illustrated. Like reference numerals increased by 100 will be used where appropriate. Similarly to the previous embodiment, the apparatus 112 includes a longitudinal slit 138 for receiving a portion 40 of the drain hose 22. Again, the slit 138 is constructed so that it will receive an end portion 40 of the drain hose 22. The apparatus 112 also includes arm members 150 and 151 that include circular projections 152 and 154 respectively sized and shaped to be received within apertures in the hoses 24 and 26. To this end, the circular projections 152 and 154 have a circumference that is substantially equal to the internal circumference of the ends 34 and 36 of the hoses. The circular projections 152 and 154 include slits 156 and 158 respectively that allow the circular projections 152 and 154 to be deformed so that their circumference can be reduced allowing them to be received within the openings of the hoses 24 and 26. Thus, the embodiment of retainer 112 is the inversion of the embodiment 12 and demonstrates how the inventive concept is utilized in both male and female species. The apparatus 112 also includes a hook 160B that is defined by a slit 160 in the base retainer 112. The hook 160B is designed to be received within the flange 42 so that the apparatus 112 can be secured to the tub 12.

The retainer apparatus 12 or 112 for removably securing the hoses 22, 24, and 26 is preferably constructed from a plastic material which is fairly rigid in that it is self-sustaining and exhibits good memory, but is also resiliently flexible, for example, high density polyethylene although other flexible materials known in the art may also be used.

Because the apparatus 12 or 112 is constructed from a flexible material, the hoses may be selectively pulled out of the cabinet 20. To this end, the apparatus 12 or 112 is constructed so that the hook member 60B or 160B will not readily tear away from the remaining portions of the hose retainer 12 or 112 or from the flange 42, but in response to a deliberate operator induced tearing action, the retainers 12 and 112 are frangible. Furthermore, while the end 40 of the drain hose 22 is normally retained in place, it can be pulled out of the slit 38 or 138 by a deliberate operator induced action. The inlet hoses 24 and 26 may remain secured to the hose retainer 12 or 112 but because the apparatus will no longer be secured to an internal structure in the cabinet the end user can remove the retaining apparatus 12 or 112 once the hoses 24 and 26 are pulled out of the appliance 10.

Referring now to FIG. 5, the automatic washing machine 10, and specifically the cabinet 20, includes access ports 65 and 67. The access ports 65 and 67 provide access to at least a portion of the hoses 22, 24, and 26 in order to afford selective removal of the hoses 22, 24, and 26 from the cabinet 20.

As illustrated in FIG. 6, the first access port 65 is disposed so that a portion 24′ and 26′ of the inlet hoses 24 and 26 is always visible and accessible through the opening 65. Preferably, the cabinet 20 includes a back-up plate 69 that is located behind the hoses 24 and 26 and thereby allows the hoses to be accessed but provides a contiguous structure to the cabinet 20 of the washing machine 10. The back-up plate 69 or bracket is secured to the inlet valve assembly 70 and both are in turn secured to the cabinet 20.

In the storage position the hoses are disposed as illustrated in FIGS. 1 and 2. To remove an end 34 and 36 of the inlet hoses so that they can be made operational, the portion of the hoses 24′ and 26′ accessible through the access port 65 is pulled outwardly causing the hoses 22 and 24 either to disengage the apparatus 12 or the apparatus 112 as the case may be, or the apparatus 12 is pulled away from the flange 42 of the tube 12. The hoses 24 and 26 are pulled until the ends 34 and 36 of the hoses 22 are pulled out from the access port 65. If the apparatus 12 is still secured to the ends 34 and 36 of the hoses 24 and 26, it can be easily removed. The free ends 34 and 36 of the inlet hoses 24 and 26 are then attached to the inlet water source.

FIG. 7 illustrates a cross-sectional view of the second access port 67 that allows access to the drain hose 22. Again, the cabinet 20 includes a back-up plate 74 that is located between the drain hose 22 and the access port 67 providing a continuation of the cabinet 20 and forming a bracket that is secured to the cabinet 20. A grommet 76 is utilized around the opening 77 in the bracket to provide a smooth surface over which the drain hose 22 is pulled or pushed.

A portion of the drain hose 22′ is pulled so that the end 40 of the drain hose exits the slit 138 or 38, is pulled through the access port 67 and is connected to a connector 71.

As illustrated in FIG. 5, the apparatus 10 also provides a means for storing the electrical cord 73 and plug 75. To this end, the plug 75 of the electrical cord 73 is received within apertures (not shown) on the back portion 79 of the apparatus 10. Accordingly, the apparatus 10 provides an automatic washing machine 10 wherein the cord 73 and plug 75, and necessary hoses 22, 24 and 26 are all safely stored for shipment yet provides an easy means for allowing selective access.

As is apparent from the foregoing speicification, the invention is susceptible of being embodied with various alterations and modifications with may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defines as follows:

1. A hose retainer for selectively removably securing free ends of a plurality of hoses to the interior of an appliance cabinet comprising:

an elongated flexible sheet-form member sized and split to form a frangible hook for suspending the hose retainer to the interior of the appliance cabinet;

said member having a slit for removably receiving a free end of a first hose; and engagement means for securing a free end of at least one second hose;

whereby, a deliberate induced action by an operator on said first hose will cause said first hose to be pulled out of said slit and a deliberate operator induced tearing action on said second hose will cause said hook to tear.

2. A hose retainer as defined in claim 1 wherein said engagement means for securing at least a second hose includes an aperture into which the second hose is inserted and including radial projections for frictionally retaining said second hose.

3. The hose retainer of claim 1 wherein said engagement means includes at least one arm having a projection extending from an end thereof installed into the end of the second hose and having deformable projections for frictionally retaining said second hose.

4. An appliance having a drain hose secured to the appliance at one end and having a free second end and at least one liquid inlet hose secured to the appliance at one end and having a free second and comprising:

a cabinet; and a hose retainer for removably securing the free end of the drain hose and the free end of the inlet hose within the cabinet, the hose retainer having at an end thereof a frangible hook for selective securement within and removal from the cabinet, the hose retainer further including a first retaining means for removably securing the free end of the drain hose within the cabinet and a second retaining means for removably securing the free end of the inlet hose within the cabinet.

5. The appliance of claim 4 wherein the cabinet is formed to provide a first access port for accessing a portion of the inlet hose and a second access port for accessing a portion of the drain hose.

6. The appliance of claim 5 wherein the cabinet includes a back-up plate behind the first and second access ports.

7. An automatic washing machine having a tub, drain hose, two inlet hoses, and a cabinet surrounding the machine comprising:

a hose retainer for selectively removably securing a free end of the drain hose and inlet hoses to a portion of the tub within the cabinet including a sheet-form member having a slit for removably receiving the free end of the drain hose and engagement means for securing the free ends of the inlet hoses to the retainer, the body member defining a disengagable hook portion for securing the retainer to the tub; and the cabinet including two access ports for accessing a portion of the drain hose and the inlet hoses; wherein a deliberate induced action by an operator on said drain hose at said access port will cause said drain hose to be pulled out of said slit and a deliberate operator induced action on said inlet hoses at said access port will cause said hook portion to disengage from the tub.

8. The washing machine of claim 7 wherein the engagement means for securing the free ends of the inlet hoses includes two apertures into which the ends of the inlet hoses may be inserted in an interference fit.

9. The washing machine of claim 8 wherein the apertures include deformable projections extending from the body member into the apertures to frictionally engage the surface of the hoses.

10. The washing machine of claim 7 wherein the engagement means for securing the free ends of the inlet hoses includes two arm members having at an end thereof, projections for being received within the end of the inlet hoses in a frictional interference fit.

11. The washing machine of claim 7 including an electrical cord and plug and the cabinet includes means for receiving the plug.

12. For use in a lanundry appliance of the type having a drain hose secured at one end to the appliance and having a free end attached to a drain, a cold water inlet hose and a hot water inlet hose, each being secured at one end to the appliance and having a free end attachable to a source of water, a hose retainer to temporarily retain the free hose ends within the interior of the appliance during assembly and shipping which includes a flexible flat member which is elongated in configuration and includes a first slit portion providing a frangible hook for engagement with an adjoining interior portion of the appliance, a first engagement means for the drain hose free end comprising a second slit portion through which the drain hose may be removably inserted and temporarily retained in an interference fit relationship, and a second engagement means for the free ends of the inlet hoses comprising two parts each sized and shaped to effect an interference fit relationship with the inlet hoses, wherein the frangible hook breaks upon removal of the inlet hoses from the cabinet.

13. The invention of claim 12 wherein the second engagement means comprises star shaped openings through while respective inlet hoses may be inserted and wherein radially inwardly extending projections engage the surface of the hoses.

14. The invention of claim 12 wherein the second engagement means comprises projecting arms having portions sized and shaped to be inserted into the free ends of the hoses and wherein such portions are made deformable by slits to frictionally engage the inner surface of the hose walls.

15. The invention of claim 12 wherein said member is made of sheet-form polyethylene.

* * * * *